US006648677B1

(12) United States Patent
Boyd

(10) Patent No.: US 6,648,677 B1
(45) Date of Patent: Nov. 18, 2003

(54) WIRING OUTLET WITH RETRACTABLE EXTENSION CORD MECHANISM

(76) Inventor: Peter A. Boyd, 5411 W. 135th St., Hawthorne, CA (US) 90250

( * ) Notice: Subject to any disclaimer, the term of this patent is extended or adjusted under 35 U.S.C. 154(b) by 0 days.

(21) Appl. No.: 10/176,732

(22) Filed: Jun. 21, 2002

Related U.S. Application Data

(60) Provisional application No. 60/304,852, filed on Jul. 11, 2001.

(51) Int. Cl.[7] ..... H01R 13/72
(52) U.S. Cl. ..... 439/501
(58) Field of Search ..... 439/501, 162

(56) References Cited

U.S. PATENT DOCUMENTS 5,562,488 A * 10/1996 Neiser et al. ..... 439/501
5,700,158 A * 12/1997 Neiser et al. ..... 439/501
5,701,981 A * 12/1997 Marshall et al. ..... 439/501
5,723,815 A * 3/1998 Pena ..... 439/501
5,738,454 A * 4/1998 Rutulante ..... 439/501

* cited by examiner

*Primary Examiner*—Gary Paumen
(74) *Attorney, Agent, or Firm*—Joseph N. Breaux

(57) ABSTRACT

A wiring outlet assembly having a fixed wiring outlet and a moveable wiring outlet socket member adapted to seat within a cavity of the assembly and removably positionable from the cavity; the removable outlet socket member being electrically connected to an extension cord in electrical connection with the fixed wiring outlet and having a retraction system for retractably extending the wiring outlet socket member a desired distance so that a user may readily connect a connector plug of a device, such as a power plug or phone jack plug, without searching for an extension cord.

1 Claim, 4 Drawing Sheets

WIRING OUTLET WITH RETRACTABLE EXTENSION CORD MECHANISM

This application claims benefit of U.S. application Ser. No. 60/304,852 filed Jul. 11, 2001.

TECHNICAL FIELD

The present invention relates to wiring outlets, such as power outlets, phone jacks, video cable connections, etc., and more particularly to a wiring outlet assembly having a fixed wiring outlet and a moveable wiring outlet socket member adapted to seat within a cavity of the assembly and removably positionable from the cavity; the removable outlet socket member being electrically connected to an extension cord in electrical connection with the fixed wiring outlet and having a retraction system for retractably extending the wiring outlet socket member a desired distance so that a user may readily connect a connector plug of a device, such as a power plug or phone jack plug, without searching for an extension cord; in a preferred embodiment, the wiring outlet socket member being held within the cavity by the tension from the retraction system such that a user must first insert a plug in order to be able to pull the wiring outlet socket member out of the cavity.

BACKGROUND ART

It is often desirable when plugging in an appliance, a phone or the like to have an extension cord which will allow the appliance or telephone to be positioned at a location that is further from the first available wiring outlet typically results in an often protracted search for an extension cord which may be used to allow the electrical appliance or telephone to be used at the desired location. It would be desirable, therefore, to have a wiring outlet that included an extendable wiring extension cord therein. In order to prevent children from playing with the wiring extension cord, it would be further desirable to have a wiring outlet with a wiring extension cord having a retraction mechanism wherein it was required to have the plug of an appliance power cord, a phone cord, or other wired device, such as a cable hookup, inserted into the outlet to sufficiently attach to the removable socket to remove it from its storage cavity adjacent the fixed wiring outlet.

GENERAL SUMMARY DISCUSSION OF INVENTION

It is thus an object of the invention to provide a wiring outlet assembly having a fixed wiring outlet and a moveable wiring outlet socket member adapted to seat within a cavity of the assembly and removably positionable from the cavity; the removable outlet socket member being electrically connected to an extension cord in electrical connection with the fixed wiring outlet and having a retraction system for retractably extending the wiring outlet socket member a desired distance so that a user may readily connect a connector plug of a device, such as a power plug or phone jack plug, without searching for an extension cord; in a preferred embodiment, the wiring outlet socket member being held within the cavity by the tension from the retraction system such that a user must first insert a plug in order to be able to pull the wiring outlet socket member out of the cavity.

Accordingly, a wiring outlet assembly is provided. The wiring outlet assembly having a fixed wiring outlet and a moveable wiring outlet socket member adapted to seat within a cavity of the assembly and removably positionable from the cavity; the removable outlet socket member being electrically connected to an extension cord in electrical connection with the fixed wiring outlet and having a retraction system for retractably extending the wiring outlet socket member a desired distance so that a user may readily connect a connector plug of a device, such as a power plug or phone jack plug, without searching for an extension cord; in a preferred embodiment, the wiring outlet socket member being held within the cavity by the tension from the retraction system such that a user must first insert a plug in order to be able to pull the wiring outlet socket member out of the cavity.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
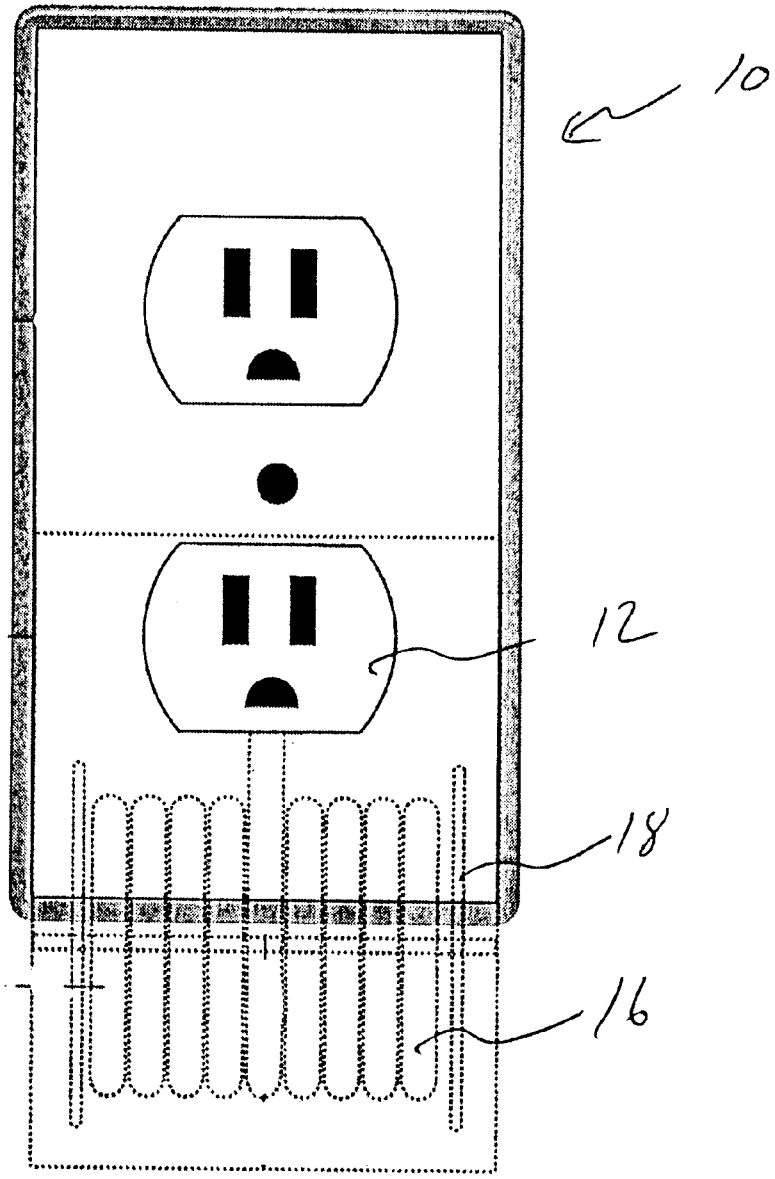
FIG. 1 is a front plan view of an exemplary embodiment of the wiring outlet of the present invention in the form of an electrical power outlet.
Figure 2:
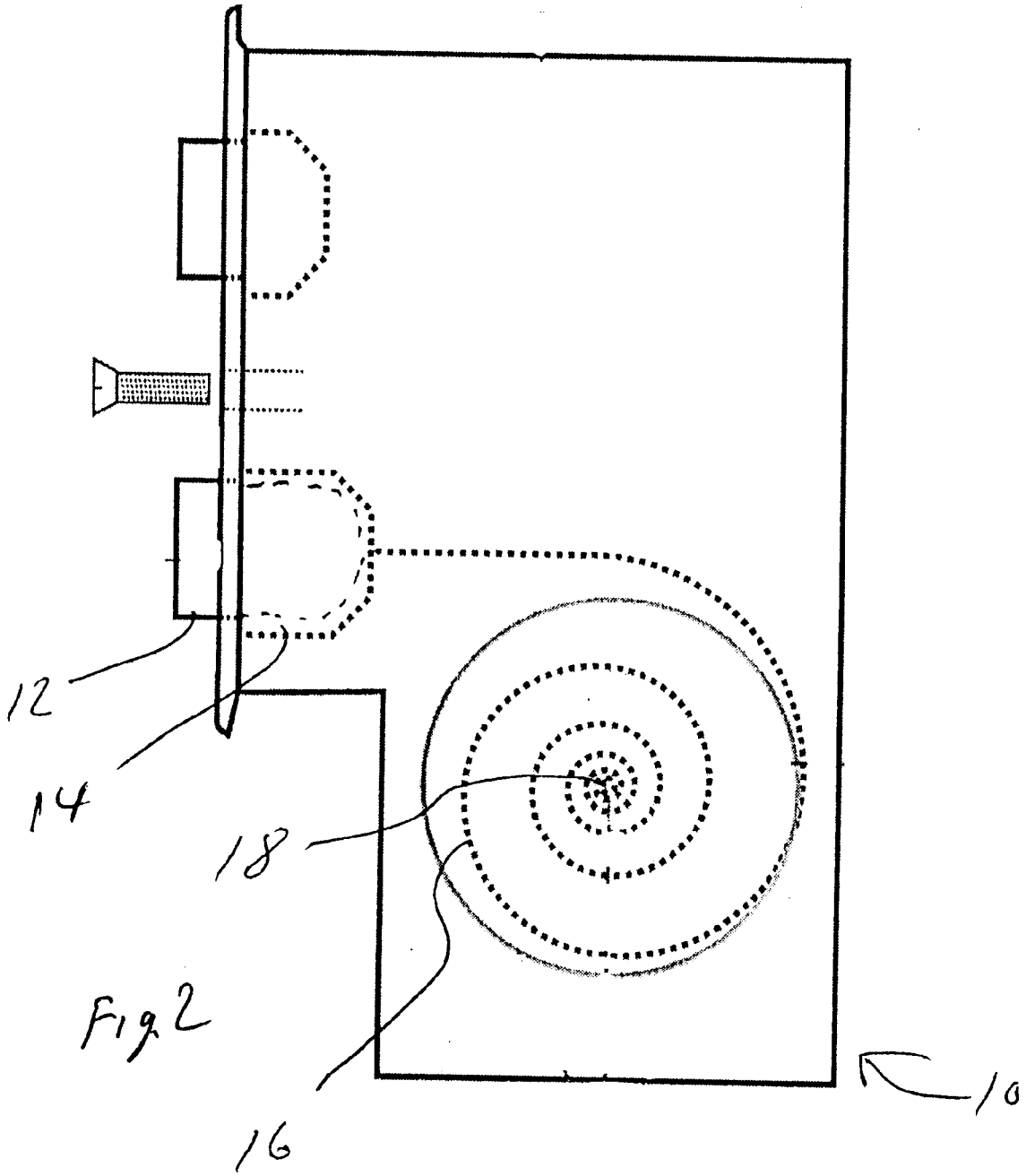
FIG. 2 is a side plan view of the electrical power outlet of FIG. 1.
Figure 5:
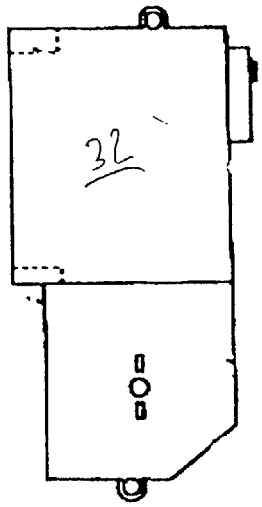
FIG. 5 is a side plan view of the mounting box of the phone jack outlet of FIG. 3.
Figure 4:
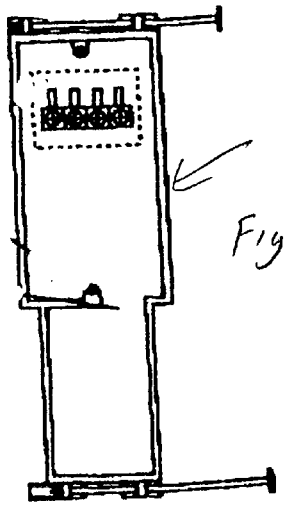
FIG. 4 is a front plan view of the mounting box of the phone jack outlet of FIG. 3.
Figure 3:
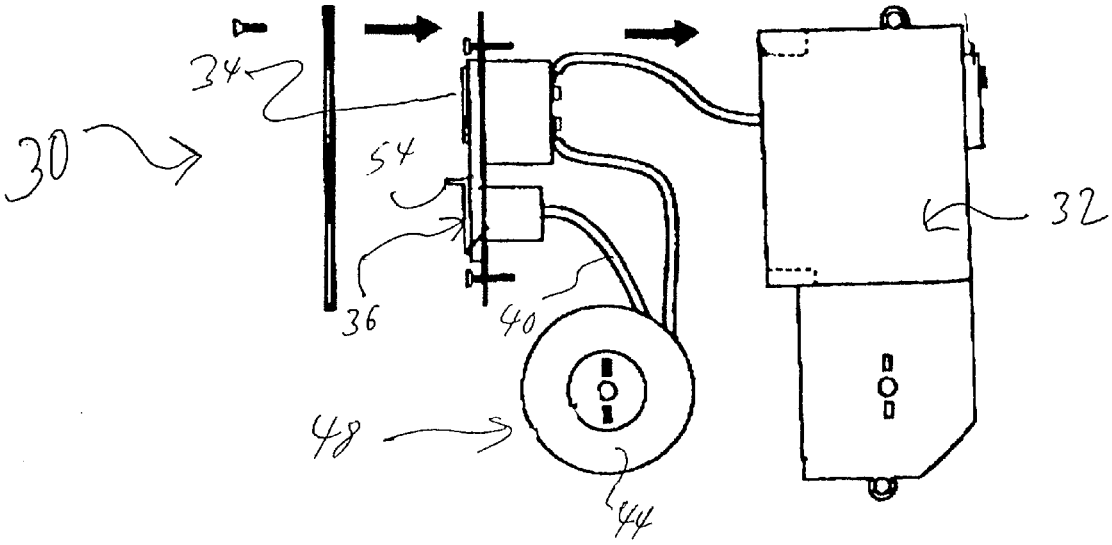
FIG. 3 is an exploded, side plan view of an exemplary embodiment of the wiring outlet of the present invention in the form of a phone jack outlet.
Figure 8:
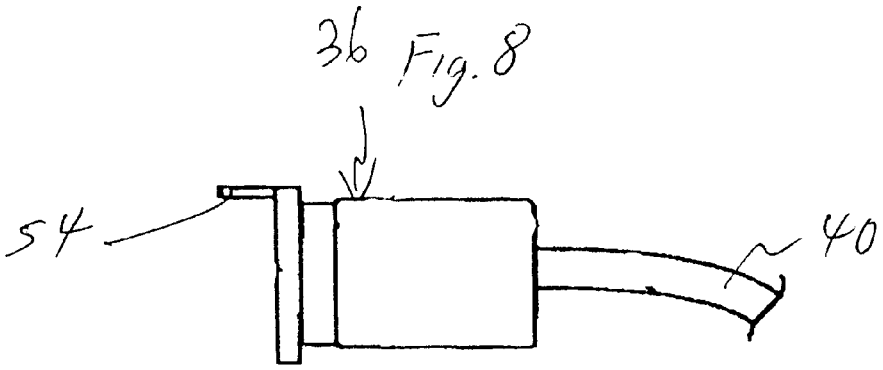
FIG. 8 is a front, detail plan view of the removable phone jack socket member in isolation.
Figure 7:
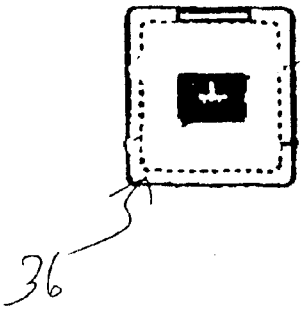
FIG. 7 is a side, detail plan view of the removable phone jack socket member attached to the end of the extension cord.
Figure 6:
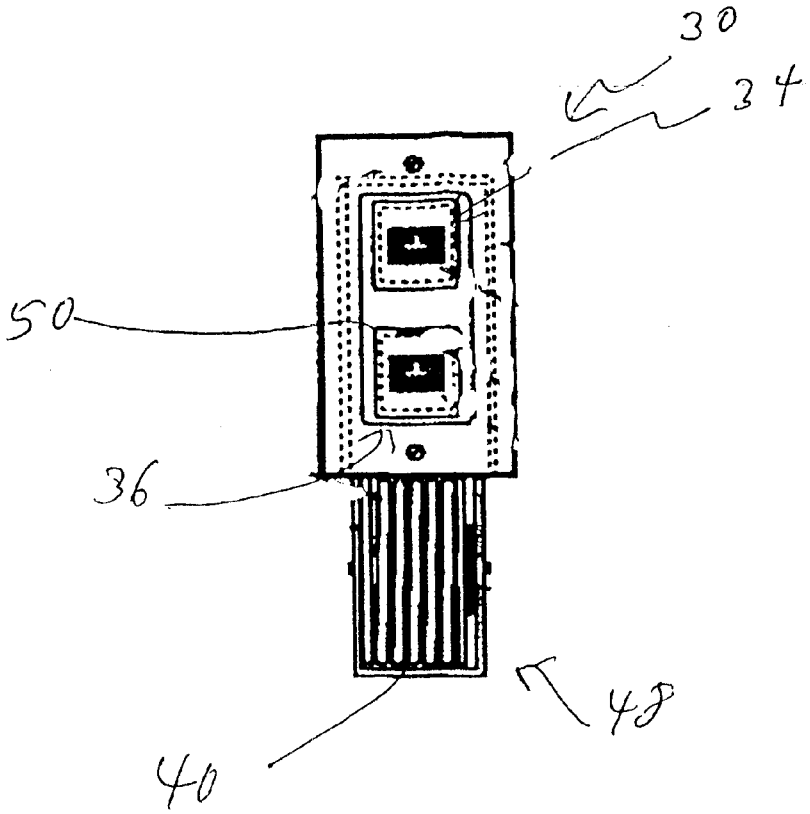
FIG. 6 is a front plan view of the phone jack outlet of FIG. 3 showing the removable phone jack socket member and the fixed phone jack.

FIGS. 1–2 show various aspects of an exemplary embodiment of the wiring outlet of the present invention in the form of an electrical outlet generally designated 10. Electrical outlet 10 includes an outlet socket member 12 adapted to seat within a cavity 14 of the assembly 10 and removably positionable from the cavity 14. The removable outlet socket member 12 is electrically connected to an extension cord 16 having a retraction system 18 for retractably extending the outlet socket member 12 a desired distance so that a user may readily connect a power cord without searching for an extension cord. The outlet socket member 12 is held within the cavity 14 by the tension from the retraction system 18 such that a user must first insert the prongs of a plug in order to be able to pull the outlet socket member 12 out of the cavity 14 thereby preventing children from pulling the socket member 12 out.

FIGS. 3–8 show various aspects of an exemplary embodiment of the wiring outlet of the present invention in the form of a phone jack outlet, generally designated 30. Phone jack outlet 30 includes a mounting box, generally designated 32, a fixed phone jack assembly, generally designated 34, and a removable phone jack socket member, generally designated 36, wired to fixed phone jack assembly 34 via an extension cord 40 retractably wound onto the reel 44 of a retraction mechanism 48. When not extended, removable phone jack socket member 36 is stored within a storage cavity 50 positioned adjacent to fixed phone jack assembly 34. In this embodiment, removable phone jack socket member 36 is provided with a pull tab 54 that extends outward therefrom to allow a user to pull removable phone jack socket member 36 out of storage cavity 50 before inserting the phone plug therein.

It can be seen from the preceding description that a wiring outlet assembly with an extension cord has been provided.

It is noted that the embodiment of the wiring outlet described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A wiring outlet assembly comprising:

a fixed wiring outlet; and a moveable wiring outlet socket member adapted to seat within a cavity of the fixed wiring outlet while being removably positionable from the cavity;

the removable outlet socket member being electrically connected to an extension cord in electrical connection with the fixed wiring outlet and having a retraction system for retractably extending the wiring outlet socket member a desired distance so that a user may readily connect a connector plug of a device, such as a power plug or phone jack plug, without searching for an extension cord;

the wiring outlet socket member being held within the cavity by the tension from the retraction system such that a user must first insert a plug in order to be able to pull the wiring outlet socket member out of the cavity.

* * * * *